US007449275B2

(12) United States Patent
Eida

(10) Patent No.: US 7,449,275 B2
(45) Date of Patent: Nov. 11, 2008

(54) PROCESS FOR PREPARING TONER

(75) Inventor: Akihiro Eida, Wakayama (JP)

(73) Assignee: Kao Corporation, Tokyo (JP)

( * ) Notice: Subject to any disclaimer, the term of this patent is extended or adjusted under 35 U.S.C. 154(b) by 505 days.

(21) Appl. No.: 11/228,259

(22) Filed: Sep. 19, 2005

(65) Prior Publication Data

US 2006/0063094 A1 Mar. 23, 2006

(30) Foreign Application Priority Data

Sep. 21, 2004 (JP) ..... 2004-274114

(51) Int. Cl.
*G03G 9/08* (2006.01)

(52) U.S. Cl. ..... 430/137.2; 430/108.7; 430/110.4

(58) Field of Classification Search ..... 430/137.18, 430/137.2, 108.7, 110.4
See application file for complete search history.

(56) References Cited

U.S. PATENT DOCUMENTS 5,716,751 A * 2/1998 Bertrand et al. ..... 430/137.18
6,109,448 A * 8/2000 Konetzka et al. ..... 209/135
2001/0010888 A1* 8/2001 Izu et al. ..... 430/110.4
2005/0095523 A1* 5/2005 Shimokusa et al. ..... 430/108.8
2005/0233236 A1 10/2005 Eida et al.
2005/0233237 A1 10/2005 Eida et al.
2005/0233238 A1 10/2005 Eida et al.

FOREIGN PATENT DOCUMENTS

JP 10-186721 * 7/1998

OTHER PUBLICATIONS

Japanese Patent Office machine-assisted translation JP 10-186721 (pub. Jul. 1998).*
U.S. Appl. No. 11/423,792, filed Jun. 13, 2006, Eida, et al.
U.S. Appl. No. 11/227,191, filed Sep. 16, 2005, Eida.
Patent Abstracts of Japan, JP 2002131979A, May 9, 2002.
Patent Abstracts of Japan, JP2004126260A, Apr. 22, 2004.

* cited by examiner

*Primary Examiner*—Janis L Dote
(74) *Attorney, Agent, or Firm*—Oblon, Spivak, McClelland, Maier & Neustadt, P.C.

(57) ABSTRACT

A process for preparing a toner including the steps of (I) melt-kneading a raw material mixture containing a resin binder and a colorant; (II) cooling the melt-kneaded mixture obtained in the step (I) and pulverizing the cooled mixture to give a pulverized product having a volume-median particle size ($D_{50}v$) of from 10 to 1000 μm; (III) pulverizing the pulverized product obtained in the step (II) in the presence of an external additive having an average particle size of from 8 to 50 nm; and (IV) classifying the pulverized product obtained in the step (III), wherein the resulting toner has a volume-median particle size ($D_{50}v$) of from 3.5 to 8 μm, and the total amount of m kind(s) of external additive(s) in the step (III) satisfies a specified formula. The toner can be used, for instance, for the development of a latent image formed in electrophotography, electrostatic recording method, electrostatic printing method or the like.

13 Claims, No Drawings

PROCESS FOR PREPARING TONER

FIELD OF THE INVENTION

The present invention relates to a process for preparing a toner used for, for example, developing an electrostatic latent image formed in electrophotography, electrostatic recording method, electrostatic printing method, or the like.

BACKGROUND OF THE INVENTION

Conventionally, toners having particle sizes of 10 μm or so have been used. With the advancement of higher image qualities in electrophotography in the recent years, toners have been desired to have smaller particle sizes. However, since the toners having smaller particle sizes have strong aggregating force between the toners as compared with those having conventional particle sizes, the toners would not be favorably dispersed during the treatment of external addition, whereby the adhesive strength of the external additive is likely to be lowered. When the external additive having such a weak adhesive strength is freed during a use of a toner in a machine, the durability of the toner may be worsened in some cases.

On the other hand, as a process for preparing a toner, a means of mixing a roughly pulverized kneaded product with a fluidity improver such as a silica or an inorganic oxide, and pulverizing the mixture is proposed (see JP2002-131979 A and JP2004-126260 A).

SUMMARY OF THE INVENTION

The present invention relates to a process for preparing a toner including the steps of:

(I) melt-kneading a raw material mixture containing a resin binder and a colorant;

(II) cooling the melt-kneaded mixture obtained in the step (I) and pulverizing the cooled mixture to give a pulverized product having a volume-median particle size ($D_{50}v$) of from 10 to 1000 μm;

(III) pulverizing the pulverized product obtained in the step (II) in the presence of an external additive having an average particle size of from 8 to 50 nm; and (IV) classifying the pulverized product obtained in the step (III), wherein the resulting toner has a volume-median particle size ($D_{50}v$) of from 3.5 to 8 μm, and the total amount of m kind(s) of external additive(s) in the step (III) satisfies the formula (a):

$$10 \le P \le 180 \qquad \text{(a)}$$

$$\text{wherein } P = \sum_{n=1}^{m} \frac{Dt \cdot \rho t}{4 \cdot dn \cdot \rho n} \times Cn \times 100 \times \frac{1}{2}$$

wherein Dt is a volume-median particle size of the desired toner ($D_{50}v$, μm); dn is an average particle size (μm) of an external additive n; ρt is a true density of mother toner particles; ρn is a true density of an external additive n; Cn is a weight ratio of an external additive n to the pulverized product obtained in the step (II) (external additive n/pulverized product obtained in the step (II)); and m is an integer of 1 or more.

DETAILED DESCRIPTION OF THE INVENTION

The present invention relates to a process for preparing a toner having a small particle size and excellent durability.

According to the present invention, a toner having a small particle size and excellent durability can be obtained.

These and other advantages of the present invention will be apparent from the following description.

The process for preparing a toner includes at least the steps of:

(I): melt-kneading a raw material mixture containing a resin binder and a colorant;

(II): cooling the melt-kneaded mixture obtained in the step (I) and pulverizing the cooled mixture;

(III): pulverizing the pulverized product obtained in the step (II) in the presence of an external additive; and (IV): classifying the pulverized product obtained in the step (III).

Especially, one of the great features of the process for preparing a toner resides in the step (III). In the present specification, the pulverization in the step (II) is referred to as "rough pulverization," and the pulverized product obtained in the step (II) is referred to as "roughly pulverized product." The pulverization in the step (III) is referred to as "fine pulverization," and the pulverized product obtained in the step (III) is referred to as "finely pulverized product."

According to the present invention, in the preparation of a toner including the steps of roughly pulverizing a kneaded product, further finely pulverizing the roughly pulverized product, and classifying the finely pulverized product, the step of finely pulverizing the roughly pulverized product is carried out in the presence of an external additive having a specified particle size, whereby a toner in which the external additive is externally added to the surface of the mother toner particle uniformly and thoroughly with an appropriate adhesive strength can be obtained. In other words, the present inventors have found that the surface treatment of the toner can be carried out concurrently with pulverization by allowing an external additive having a specified particle size to exist in the finely pulverizing step during which the roughly pulverized product has excellent dispersibility in a pulverizer, whereby consequently a toner having excellent durability, to which the external additive is excellently adhered even when the particle size of the toner is small, can be obtained.

In the present invention, when a toner having a small particle size is prepared, a proper amount of the external additive is allowed to exist during the pulverization, so that a toner to which the external additive is excellently adhered can be finally obtained.

The external additive usable in the step (III) may be one kind or a plural kinds, without being particularly limited thereto. The total amount of m kind(s) of external additive(s) satisfies the formula (a):

$$10 \le P \le 180 \qquad \text{(a)}$$

$$\text{wherein } P = \sum_{n=1}^{m} \frac{Dt \cdot \rho t}{4 \cdot dn \cdot \rho n} \times Cn \times 100 \times \frac{1}{2}$$

wherein Dt is a volume-median particle size of the desired toner ($D_{50}v$, μm); dn is an average particle size (μm) of an external additive n; ρt is a true density of mother toner particles; ρn is a true density of an external additive n; Cn is a weight ratio of an external additive n to the roughly pulverized product (external additive n/roughly pulverized product); and m is an integer of 1 or more. In the formula (a), $$\sum_{n=1}^{m} \frac{Dt \cdot \rho t}{4 \cdot dn \cdot \rho n} \times Cn \times 100$$

represents a coating ratio of the external additive to the mother toner particles. The reason why P is obtained by multiplying the formula by a factor of ½ is because the external additive remaining on the surface of the toner after the pulverization is generally about 50% of the external additive used during the pulverization. The remainder 50% or so is collected together with fine powders. In the present invention, the term "mother toner particles" refers to a toner having no external additive on its surface. The true density of the mother toner particles can be determined according to the method described in Examples set forth below. This true density can be estimated from the values for the toners which has already been treated with an external additive as a reference.

The lower limit of the formula (a) is 10 or more, preferably 20 or more, and more preferably 30 or more, from the viewpoint of giving fluidity. In addition, the upper limit of the formula (a) is 180 or less, preferably 160 or less, more preferably 155 or less, and even more preferably 140 or less, in order to suppress the generation of free external additives in the obtained toners.

The external additive is preferably an inorganic oxide such as silica, titania, alumina, zinc oxide, magnesium oxide, cerium oxide, iron oxide, copper oxide, or tin oxide. Among them, silica is preferable, from the viewpoint of giving chargeability.

Fine powders of silica ($SiO_2$) may be prepared by any of dry method or wet method. In addition, besides anhydrous silica, the fine powders of silica may be aluminum silicate, sodium silicate, potassium silicate, magnesium silicate or zinc silicate, of which $SiO_2$ content is 85% by weight or more is preferable.

In addition, the surface of the external additive may be subjected to hydrophobic treatment. The hydrophobic treatment method is not particularly limited. The hydrophobic treatment agent includes silane coupling agents such as hexamethyl disilazane (HMDS) and dimethyl dichlorosilane (DMDS); silicone oil treatment agents such as dimethyl silicone oil and amino-modified silicone oil; and the like. Among them, silane coupling agents are preferable. The amount treated by the hydrophobic treatment agent is preferably from 1 to 7 $mg/m^2$ per surface area of the external additive.

The external additive has an average particle size of from 8 to 50 nm, preferably from 8 to 40 nm, and more preferably from 12 to 20 nm, from the viewpoint of giving fluidity. Here, the average particle size is a number-average particle size.

Processes for finely pulverizing the roughly pulverized products in the presence of the external additive include a process including the step of previously mixing a roughly pulverized product and an external additive before pulverization; a process including the step of mixing a roughly pulverized product and an external additive and at the same time feeding the mixture to a pulverizer; a process including the step of feeding a roughly pulverized product and an external additive each from a separate feeding port to a pulverizer; and the like, without being particularly limited thereto. In the present invention, the process including the step of previously mixing the roughly pulverized product and the external additive, in other words, a process including the step of mixing a roughly pulverized product obtained in the step (II) and an external additive before proceeding to the step (III) is preferable, from the viewpoint of adhesion of the external additive.

When the roughly pulverized product and the external additive are fed into the pulverizer, the pulverization proceeds by an impact between the roughly pulverized products while another impact occurs between the (roughly) pulverized product and the external additive, so that the external additive is adhered to the surface of the pulverized product. When the external additive is present in an amount corresponding to the desired toner, an appropriate amount of the external additive can be adhered to the surface of the mother toner particles with adhesive strength.

The roughly pulverized product and the external additive can be mixed, for example, with a mixer capable of agitating at a high speed, such as a HENSCHEL MIXER or a Super mixer.

The pulverizer usable in the fine pulverization of the step (III) includes a jet type pulverizer such as a fluidized bed type jet mill and a gas stream type jet mill; a mechanical pulverizer such as a turbo mill; and the like. In the present invention, the fluidized bed type jet mill is preferable.

As a fluidized bed type jet mill usable in the present invention, preferable is a pulverizer having the structure and principle for finely pulverizing the particles, containing at least a pulverization chamber arranged facing two or more jet nozzles in its lower portion thereof, in which a fluidized bed is formed with the particles fed into the pulverizing container by a high-speed gas jet stream discharged from the jet nozzles wherein the particles are finely pulverized by repeating the acceleration of the particles and impact between the particles. The pulverization pressure in the fluidized bed type jet mill is preferably from 0.5 to 1 MPa and more preferably from 0.6 to 0.9 MPa from the viewpoint of even adhesion of the external additive to the toner.

In the pulverizer having the above-mentioned structure, the number of jet nozzles is not particularly limited. It is preferable that two or more jet nozzles, and preferably from 3 to 4 jet nozzles are arranged facing each other, from the viewpoint of balance between volume of air, amount of flow and flow rate, impact efficiency of the particles, and the like.

Further, a classifying rotor for capturing uplifted particles having small particle sizes downsized by pulverization is provided in an upper part of the pulverization chamber. The particle size distribution can be easily adjusted by a rotational speed of the classifying rotor. The finely pulverized product (classified powder obtained by cutting off its upper limit) can be obtained by classifying the pulverized product with the classifying rotor.

The classifying rotor may be arranged in any of longitudinal direction and latitudinal direction against the vertical direction. It is preferable that the classifying rotor is arranged in the longitudinal direction, from the viewpoint of classifying performance.

Specific examples of a fluidized bed type jet mill containing two or more jet nozzles and further containing a classifying rotor include pulverizers disclosed in JP-A-Showa-60-166547 and JP2002-35631 A.

The fluidized-bed jet mill which may be preferably used in the present invention includes the "TFG" Series commercially available from Hosokawa Micron Corporation, the "AFG" Series commercially available from Hosokawa Micron Corporation, and the like.

In addition, the gas stream type jet mill includes, for example, an impact type jet mill containing a venturi nozzle and an impact member arranged so as to face the venturi nozzle, and the like.

The gas stream type jet mill which may be preferably used in the present invention includes the "IDS" Series commercially available from Nippon Pneumatic Mfg. Co., Ltd., and the like.

The finely pulverized product has a volume-median particle size ($D_{50}v$) of preferably from 3 to 7.5 μm, and more preferably from 3.5 to 7 μm.

The steps (I), (II), and (IV) will be explained hereinbelow.

The step (I) is a step of melt-kneading a raw material mixture containing a resin binder and a colorant.

The resin binder includes polyesters, styrene-acrylic resins, a mixed resin of a polyester and a styrene-acrylic resin, a hybrid resin containing two or more resin components, and the like. The resin binder containing a polyester as a main component is preferable, from the viewpoint of dispersibility of the colorant and transparency. The polyester is contained in the resin binder in an amount of preferably from 50 to 100% by weight, and more preferably from 70 to 100% by weight. As the hybrid resin, a resin in which a polycondensation resin, such as a polyester, a polyester-polyamide or a polyamide, and an addition polymerization resin such as a vinyl polymer-based resin are partially chemically bonded to each other is preferable. The hybrid resin may be obtained by using two or more resins as raw materials, or the hybrid resin may be obtained by using a mixture of one kind of resin and raw material monomers for the other resin. In order to efficiently obtain a hybrid resin, those obtained from a mixture of raw material monomers of two or more resins are preferable.

The raw material monomer for the polyester is not particularly limited, as long as a known alcohol component and a known carboxylic acid component such as carboxylic acids, acid anhydrides thereof and esters thereof are used.

The alcohol component includes an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.2)-2,2-bis(4-hydroxyphenyl)propane; ethylene glycol, propylene glycol, glycerol, pentaerythritol, trimethylolpropane, hydrogenated bisphenol A, sorbitol, or an alkylene (2 to 4 carbon atoms) oxide (average number of moles: 1 to 16) adduct thereof; and the like.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as 1,2,4-benzenetricarboxylic acid (trimellitic acid) and pyromellitic acid; acid anhydrides thereof, alkyl (1 to 3 carbon atoms) esters thereof, and the like.

The polyester can be prepared by, for example, polycondensation of the alcohol component and the carboxylic acid component at a temperature of from 180° to 250° C. in an inert gas atmosphere in the presence of an esterification catalyst as desired.

The polyester has an acid value of preferably from 5 to 40 mg KOH/g, more preferably from 10 to 35 mg KOH/g, and even more preferably from 15 to 30 mg KOH/g.

In addition, the polyester has a softening point of preferably from 80° to 165° C. and a glass transition temperature of preferably from 50° to 85° C.

As the colorants, all of the dyes, pigments, and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner prepared according to the present invention may be any of black toners and color toners. The amount of the colorant used is preferably from 1 to 40 parts by weight, and more preferably from 3 to 10 parts by weight, based on 100 parts by weight of the resin binder.

In the present invention, additives such as charge control agents, releasing agents, fluidity improvers, electric conductivity modifiers, extenders, reinforcing fillers such as fibrous substances, antioxidants, anti-aging agents, cleanability improvers, and magnetic materials may be further contained as raw materials in the toner.

The releasing agent includes natural ester waxes such as carnauba wax and rice wax; synthetic waxes such as polypropylene wax, polyethylene wax and Fischer-Tropsch wax; petroleum waxes such as paraffin waxes; coal waxes such as montan wax; alcohol waxes; and the like. These waxes may be contained alone or in admixture of two or more kinds.

The releasing agent has a melting point of preferably from 50° to 120° C., and more preferably from 60° to 120° C., from the viewpoint of low-temperature fixing ability and offset resistance.

The amount of the releasing agent contained is preferably from 2 to 40% by weight, and more preferably from 5 to 20% by weight, of the raw materials, from the viewpoint of offset resistance and durability. Usually, when the releasing agent is used in a large amount, the pulverized product is easily fused to each other during the pulverization, thereby making it likely to lower the pulverization efficiency. In the present invention, even when the releasing agent is used in a somewhat larger amount, pulverization can be efficiently carried out.

In the present invention, it is preferable that the raw materials of an additive such as a resin binder, a colorant, or a releasing agent, or the like is previously mixed with a HENSCHEL MIXER and subjected to the step of melt-kneading. The melt-kneading of the raw material mixture can be carried out according to the conventional method with a closed type kneader, a closed type single-screw or twin-screw extruder, an open-roller type kneader or the like.

For example, an open-roller type kneader refers to a kneader containing at least two rollers, and a melt-kneading member is an open type, and it is preferable that at least two of the rollers are a heat roller and a cooling roller. The open-roller type kneader can easily dissipate the kneading heat generated during the melt-kneading. In addition, it is preferable that the open-roller type kneader is a continuous type kneader, from the viewpoint of production efficiency.

Further, in the above-mentioned open-roller type kneader, two of the rollers are arranged in parallel closely to each other, and the gap between the rollers are preferably from 0.01 to 5 mm, and more preferably from 0.05 to 2 mm. In addition, structures, sizes, materials, and the like of the roller are not particularly limited. Also, the roller surface may be any of smooth, wavy, rugged or other surfaces.

The number of rotation of the roller, i.e. the peripheral speed of the roller, is preferably from 2 to 100 m/min. The peripheral speed of the cooling roller is preferably from 2 to 100 m/min, more preferably from 10 to 60 m/min, and even more preferably 15 to 50 m/min. In addition, it is preferable that the two rollers have different peripheral speeds from each other, and that the ratio of the peripheral speed of the two rollers (cooling roller/heat roller) is preferably from 1/10 to 9/10, and more preferably from 3/10 to 8/10.

In order to facilitate adhesion of the kneaded product to the heat roller, it is preferable that the temperature of the heat roller is adjusted to be higher than both the softening point of the resin binder and the melting point of the wax, and that the temperature of the cooling roller is adjusted to be lower than both the softening point of the resin binder and the melting point of the wax. Specifically, the temperature of the heat roller is preferably from 80° to 200° C., and the temperature of the cooling roller is preferably from 20° to 140° C.

The difference in temperature between the heat roller and the cooling roller is preferably from 60° to 150° C., and more preferably from 80° to 120° C.

Here, the temperature of the roller can be adjusted by, for example, a heating medium passing through the inner portion of the roller, and each roller may be divided in two or more portions in the inner portion of the roller, each being communicated with heating media of different temperatures.

It is preferable that the temperature of the heat roller, especially the raw material feeding side of the heat roller, is adjusted to be higher than both the softening point of the resin binder and the melting point of each wax, more preferably a temperature calculated from the temperature higher than the higher of the softening point of the resin binder and the melting point of each wax plus 0° to 80° C., and even more preferably a temperature calculated from the temperature plus 5° to 50° C. It is preferable that the temperature of the cooling roller is adjusted to be lower than both of the softening point of the resin binder and the melting point of each wax, more preferably a temperature calculated from the temperature lower than the lower of the softening point of the resin binder and the melting point of each wax minus 0° to 80° C., and even more preferably a temperature calculated from the temperature minus 40° to 80° C.

The step (II) is a step of cooling the melt-kneaded mixture obtained in the step (I) and roughly pulverizing the cooled mixture.

The temperature to which the melt-kneaded mixture is cooled is not particularly limited, as long as the melt-kneaded mixture is properly cooled to a pulverizable hardness.

The rough pulverization can be carried out with Atomizer, Rotoplex, or the like.

The roughly pulverized product has a volume-median particle size ($D_{50}v$) of from 10 to 1000 μm, preferably from 10 to 250 μm, and more preferably from 10 to 100 μm, from the viewpoint of pulverizability.

The roughly pulverized product obtained in the step (II) is subjected to the above-mentioned step (III), and the resulting finely pulverized product is subjected to the subsequent step (IV).

The step (IV) is a step of classifying the pulverized product obtained in the step (III).

The classifier usable in the step (IV) includes air classifiers, rotor type classifiers, sieve classifiers, and the like. In the present invention, it is preferable that the classifier contains a classifying rotor containing a driving shaft arranged in a casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor, from the viewpoint of ability of removing fine powders. Specific examples of the classifier having the structure described above include a classifier shown in FIG. 2 of JP-A-Hei-11-216425, a classifier shown in FIG. 6 of JP2004-78063 A, commercially available classifiers such as the "TSP" Series commercially available from Hosokawa Micron Corporation, and the like. The classification mechanism will be schematically explained hereinbelow.

The pulverized product fed into a casing of a classifier descends along a classification zone on the outer circumference of the classifying rotor while being led by the spiral guide vane. The inner part of the classifying rotor and the classification zone are communicated via a classifying vane provided on the surface of the outer circumference of the classifying rotor. When the pulverized product is descended, fine powders carried along with a classifying air are aspirated to the inner part of the classifying rotor via the classifying vane, and discharged from a discharging outlet for fine powders. On the other hand, coarse powders that are not carried along with the classifying air are descended along the classification zone by gravitational force, and discharged from a discharging outlet for coarse powders.

Further, it is preferable that the classifier usable in the step (IV) has two classifying rotors sharing the same driving shaft as a central shaft thereof in one casing, and that each of the classifying rotors independently rotates in the same direction. Specific examples of the classifiers provided with a classifying rotor on each of two top and bottom stages include a classifier shown in FIG. 1 of JP2001-293438 A, commercially available classifiers such as the "TTSP" Series commercially available from Hosokawa Micron Corporation, and the like.

When a classifying rotor is provided on each of two top and bottom stages, an even higher precision classification can be achieved by adjusting an aspiration rate of classifying air, a rotational speed in each classifying rotor, or the like.

For example, the ratio of the rotational speed of the upper classifying rotor to the rotational speed of the lower classifying rotor (the rotational speed of the upper classifying rotor/the rotational speed of the lower classifying rotor) is preferably from 1/1.05 to 1.05/1, and more preferably 1/1, from the viewpoint of preventing turbulence.

In addition, it is preferable that the amount of air flow introduced from an upper air aspiration inlet to the amount of air flow introduced from a lower air aspiration inlet is nearly equal, from the viewpoint of classification precision and yield of toner.

It is preferable that the classifier usable in the step (IV) is used in the classification to cut off its lower limit in order to remove mainly fine powders. The fine powders removed during the classifying step may be subjected to the step (IV) so as to recapture the necessary portion of the fine powders by re-classification.

The toner obtained by the present invention has a volume-median particle size ($D_{50}v$) of from 3.5 to 8 μm, preferably from 3.5 to 7 μm, more preferably from 3.5 to 6.5 μm, and even more preferably from 4 to 6 μm. In addition, the toner has a number-median particle size ($D_{50}p$) of preferably from 3 to 7.5 μm, more preferably from 3 to 6.5 μm, and even more preferably 3 to 6 μm. The toner obtained by the present invention, wherein the finely pulverizing step is carried out in the presence of the external additive, has sufficient dispersibility even when the toner has a small particle size. Since the toner has low aggregation property, the external additive may further be added to the toner after the fine pulverization. In other words, the process in the present invention may further include the step (V) of adding the external additive to the toner obtained in the step (IV).

The standard deviation of the volume base particle size distribution of the toner is preferably ¼ of $D_{50}v$ or less, and more preferably from 1/7 to 1/4 of $D_{50}v$, from the viewpoint of extending the life of the toner by applying the same level of the shearing on each toner in the developing machine.

The particles having particle sizes of ($1.4\times D_{50}v$) μm or more are contained in an amount of preferably 5% by volume or less, and more preferably 4% by volume or less, in the toner, from the viewpoint of suppressing the increase of the free external additive due to reduction of the specific surface area of the toner, thereby improving durability of the toner. On the other hand, the particles having a particle size of ($0.6\times D_{50}p$) μm or less is contained in an amount of preferably 5% by number or less, and more preferably 4% by number or less, in the toner, from the viewpoint of preventing the lowering of fluidity and chargeability associated with absence of the external additive due to the increase in the specific surface area of the toner, thereby improving durability of the toner.

The toner obtainable by the present invention can be used without particular limitation in any of the development method alone as a toner for magnetic monocomponent development in the case where fine magnetic material powder is contained, or as a toner for nonmagnetic monocomponent development or as a toner for two-component development by mixing the toner with a carrier in the case where fine magnetic material powder is not contained.

EXAMPLES

The following examples further describe and demonstrate embodiments of the present invention. The examples are given solely for the purposes of illustration and are not to be construed as limitations of the present invention.

[Softening Point of Resins]

The softening point refers to a temperature corresponding to h/2 of the height (h) of the S-shaped curve when plotting a downward movement of a plunger (flow length) against temperature, namely, a temperature at which a half of the resin flows out, when measured by using a flow tester (CAPILLARY RHEOMETER "CFT-500D," commercially available from Shimadzu Corporation), in which a 1 g sample is extruded through a nozzle having a die pore size of 1 mm and a length of 1 mm, while heating the sample so as to raise the temperature at a rate of 6° C./min and applying a load of 1.96 MPa thereto with the plunger.

[Glass Transition Temperature of Resins]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a rate of 10° C./min.

[Volume-Median Particle Size ($D_{50}v$) of Roughly Pulverized Product]

(1) The amount 100 g of the roughly pulverized product is sifted through sieves having openings of 2000 μm, 1000 μm, 850 μm, 500 μm, 355 μm, 250 μm, 150 μm, 75 μm, and 45 μm. The sifting is started from a sieve having the largest opening, and the roughly pulverized product which passes through the sieve is sifted with sieves in the order of descending sizes from large opening to small opening.

(2) The weight of the roughly pulverized product remaining on each sieve is determined to calculate a mass base frequency (%).

(3) The volume-median particle size ($D_{50}v$) of the roughly pulverized product is calculated according to the following formula:

$D_{50}v(\mu m)$ = 2000×(mass base frequency of roughly pulverized product on a sieve having an opening of 2000 μm)+
1000×(mass base frequency of roughly pulverized product on a sieve having an opening of 1000 μm) +
850×(mass base frequency of roughly pulverized product on a sieve having an opening of 850 μm) +
500×(mass base frequency of roughly pulverized product on a sieve having an opening of 500 μm) +
355×(mass base frequency of roughly pulverized product on a sieve having an opening of 355 μm) +
250×(mass base frequency of roughly pulverized product on a sieve having an opening of 250 μm) +
150×(mass base frequency of roughly pulverized product on a sieve having an opening of 150 μm) +
75×(mass base frequency of roughly pulverized product on a sieve having an opening of 75 μm) +

-continued

45 × (mass base frequency of roughly pulverized product on a sieve having an opening of 45 μm)

[Average Particle Size of External Additive]

The average particle size of the external additive is calculated according to the following formula:

$$\text{Average Particle Size } (\mu m) = 6/(\rho \times \text{Specific Surface Area } (m^2/g)),$$

wherein ρ is a specific gravity of an external additive, and the specific surface area is a BET specific surface area obtained by nitrogen absorption method of an original product before the hydrophobic treatment. The specific gravity of silica is 2.2, and the specific gravity of titanium oxide is 4.2.

Supposing that the external additive is a sphere having a particle size R, the above formula can be obtained as follows:

$$BET \text{ Specific Surface Area} = S \times (1/m)$$

$$m \text{ (Weight of Particles)} = 4/3 \times \pi \times (R/2)^3 \times \text{Density}$$

$$S \text{ (Surface Area)} = 4\pi(R/2)^2$$

[Particle Size Distribution of Toner]

The particle size distribution of the toner is determined with a coulter counter "Coulter Multisizer II" (commercially available from Beckman Coulter) according to the following method.

(1) Preparation of Dispersion: 10 mg of a sample to be measured is added to 5 ml of a dispersion medium (a 5% by weight aqueous solution of "EMULGEN 109P" (commercially available from Kao Corporation, polyoxyethylene lauryl ether, HLB: 13.6)), and dispersed with an ultrasonic disperser for one minute. Thereafter, 25 ml of electrolytic solution ("Isotone II" (commercially available from Beckman Coulter)) is added thereto, and the mixture is further dispersed with the ultrasonic disperser for one minute, to give a dispersion.

(2) Measuring Apparatus: Coulter Multisizer II (commercially available from Beckman Coulter)

Aperture Diameter: 100 μm

Range of Particle Sizes to Be Determined: 2 to 60 μm

Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds.

(4) The volume-median particle size ($D_{50}v$, μm), the number-median particle size ($D_{50}p$, μm), the content (% by volume) of the particles having particle sizes of ($1.4 \times D_{50}v$) μm or more, the content (% by number) of the particles having particle sizes of ($0.6 \times D_{50}p$) μm or less, and the standard deviation in the volume base particle size distribution are obtained from the found values.

[True Density]

The true density (g/cm$^3$) of the sample is determined with "MULTIVOLUME PYCNOMETER 1305" (commercially available from Shimadzu Corporation). A 10 cm$^3$ vessel for samples is used during the measurement, and helium gas purge is carried out at 19.3 to 19.7 psi·G (1 psi=$6.89476 \times 10^5$ Pa) 3 times as a pretreatment of the sample. The true density is determined 3 times and an average of the determination is defined as true density.

Here, "MULTIVOLUME PYCNOMETER 1305" is an apparatus for determining a true density from a volume of the sample and a weight thereof, in which the volume of the sample is determined on the basis of the Boyle's Law from a pressure when a sample chamber having a constant volume packed with a sample having an unknown volume, is charged with helium gas and a pressure after this sample chamber is connected with an expansion chamber of a constant volume.

Preparation Example of Resin

The amount 568 g of polyoxypropylene(2.2)-2,2-bis(4-hydroxyphenyl)propane, 792 g of polyoxyethylene(2.2)-2,2-bis(4-hydroxyphenyl)propane, 640 g of terephthalic acid, and 10 g of tin octylate were reacted at 210° C. under a nitrogen atmosphere while stirring. The degree of polymerization was monitored by the softening point, and the reaction was terminated when the softening point reached 110° C. The resulting resin is referred to as a resin A. The resin A had a glass transition temperature of 68° C.

Examples 1 to 3 and 7

One hundred parts by weight of the resin A, 4.5 parts by weight of a colorant "ECB-301" (commercially available from DAINICHISEIKA COLOR & CHEMICALS MFG. CO., LTD.), 6.0 parts by weight of a releasing agent "Carnauba Wax C1" (commercially available from Kato Yoko), and 0.2 parts by weight of a charge control agent "BONTRON E-304" (commercially available from Orient Chemical Co., Ltd.) were mixed with a HENSCHEL MIXER, and the resulting mixture was kneaded with a continuous twin open-roller type kneader "Kneadex" (commercially available from MITSUI MINING COMPANY, LIMITED), to give a kneaded mixture.

Incidentally, the continuous twin open-roller type kneader used has a roller having an outer diameter of 0.14 m and an effective length of 0.8 m, and the operating conditions are a rotational speed of a higher rotation side roller (front roller) of 75 r/min, a rotational speed of a lower rotation side roller (back roller) of 50 r/min, and a gap between the rollers of 0.1 mm. The temperatures of the heating medium and the cooling medium inside the rollers are as follows. The higher rotation side roller has a temperature at the raw material feeding side of 150° C., and a temperature at the kneaded mixture discharging side of 130° C., and the lower rotation side roller has a temperature at the raw material feeding side of 35° C., and a temperature at the kneaded mixture discharging side of 30° C. In addition, the feeding rate of the raw material mixture was 10 kg/hour.

Next, the resulting kneaded mixture was cooled in the air, and thereafter the cooled mixture was roughly pulverized with Alpine Rotoplex (commercially available from Hosokawa Micron Corporation), to give a roughly pulverized product having a volume-median particle size ($D_{50}v$) of 500 μm.

The external additive shown in Table 1 was mixed with 100 parts by weight of the resulting roughly pulverized product in a HENSCHEL MIXER, and the resulting mixture was finely pulverized with a counter jet mill "400AFG" (commercially available from Hosokawa Micron Corporation) at a pulverization pressure of 0.8 MPa, to give a finely pulverized product (classified powder obtained by cutting off its upper limit).

Further, the finely pulverized product (classified powder obtained by cutting off its upper limit) is classified by cutting off its lower limit (removal of fine powers) with a classifier "TTSP" (commercially available from Hosokawa Micron Corporation), to give a toner. The particle size distribution and the true density of the resulting toner and the values of the formula (a) are shown in Table 2.

Example 4

The same procedures as in Example 1 were carried out except that the amount of "Carnauba Wax C1" was changed to 2.0 parts by weight and a twin-screw kneader having a heating temperature inside the roller of 100° C. was used as a kneader in place of the open-roller type kneader, to give a toner. Further, 0.5 parts by weight of a hydrophobic silica "RY-50" (commercially available from Nippon Aerosil) were externally added to 100 parts by weight of the resulting toner with a HENSCHEL MIXER.

Example 5

The same procedures as in Example 1 were carried out except that a dispersion separator "DS" (commercially available from Nippon Pneumatic Mfg. Co., Ltd.) was used as a classifier in place of "TTSP," to give a toner.

Comparative Example 1

The same procedures as in Example 1 were carried out except that a hydrophobic silica "R972"(commercially available from Nippon Aerosil) was not used in the rough pulverization, to give a toner. Further, 0.5 parts by weight of "R972" were externally added to 100 parts by weight of the resulting toner with a HENSCHEL MIXER.

Comparative Example 2

The same procedures as in Example 1 were carried out except that 4.0 parts by weight of "H3004" (commercially available from Wacker Chemicals) were used as a hydrophobic silica in place of "R972," to give a toner.

Comparative Example 3

The same procedures as in Example 1 were carried out except that the amount of "Carnauba Wax C1" was changed to 2.0 parts by weight, that "R972" (commercially available from Nippon Aerosil) was not used in the rough pulverization, and a twin-screw kneader having a heating temperature inside the roller of 100° C. was used as a kneader in place of the open-roller type kneader, to give a toner. Further, 0.5 parts by weight of "R972" were externally added to 100 parts by weight of the resulting toner with a HENSCHEL MIXER.

TABLE 1

| | External Additive[1)] to Be Mixed with Roughly Pulverized Product | Average Particle Size (nm) | True Density | BET Specific Surface Area[2)] | Amount (Parts by Weight) | Kneader | Pulverizer | Classifier | External Additive[3)] to Be Mixed with Toner After Classification |
|---|---|---|---|---|---|---|---|---|---|
| Ex. No. | | | | | | | | | |
| 1 | R972 | 16 | 2.2 | 130 | 1.0 | Open Roller | 400AFG | TTSP | — |
| 2 | R972 | 16 | 2.2 | 130 | 1.2 | Open Roller | 400AFG | TTSP | — |
| | HVK2150 | 12 | 2.2 | 200 | 0.4 | | | | |
| | HDK H13TX | 16 | 2.2 | 130 | 0.2 | | | | |
| 3 | RY-50 | 40 | 2.2 | 50 | 1.0 | Open Roller | 400AFG | TTSP | — |
| | H3004 | 8 | 2.2 | 300 | 2.5 | | | | |
| | JMT-150IB | 15 | 3.8 | 90 | 0.5 | | | | |
| 4 | R972 | 16 | 2.2 | 130 | 1.0 | Twin Screw | 400AFG | TTSP | RY-50(0.5) |
| 5 | R972 | 16 | 2.2 | 130 | 1.0 | Open Roller | 400AFG | DS | — |
| 6 | R972 | 16 | 2.2 | 130 | 1.0 | Open Roller | IDS-5 | TTSP | — |
| 7 | R972 | 16 | 2.2 | 130 | 5.0 | Open Roller | 400AFG | TTSP | — |
| | HVK2150 | 12 | 2.2 | 200 | 0.3 | | | | |
| | HDK H13TX | 16 | 2.2 | 130 | 1.2 | | | | |
| Comp. Ex. No. | | | | | | | | | |
| 1 | — | — | — | — | — | Open Roller | 400AFG | TTSP | R972(0.5) |
| 2 | H3004 | 8 | 2.2 | 300 | 4.0 | Open Roller | 400AFG | TTSP | — |
| 3 | — | — | — | — | — | Twin Screw | 400AFG | DS | R972(0.5) |

[1),3)]R972: Hydrophobic silica commercially available from Nippon Aerosil RY-50: Hydrophobic silica commercially available from Nippon Aerosil HVK2150: Hydrophobic silica commercially available from Wacker Chemicals H3004: Hydrophobic silica commercially available from Wacker Chemicals HDK H13TX: Hydrophobic silica commercially available from Wacker Chemicals JMT-150IB: Hydrophobic titania, commercially available from Tayca

[2)]The BET specific surface area is a BET specific surface area of an original product before hydrophobic treatment.

Example 6

The same procedures as in Example 1 were carried out except that a jet mill pulverizer "IDS-5" (commercially available from Nippon Pneumatic Mfg. Co., Ltd.) was used in place of the counter jet mill "400AFG," to give a toner.

Test Example 1

A toner was loaded to a printer "MicroLine 9300PS" (commercially available from Oki Data Corporation, resolution: 1200 dpi×600 dpi). Fixed images having a printing ratio of 5% were continuously printed for 24000 sheets. The film resistance was evaluated by visually examining whether or not lines are generated due to filming. In addition, in cases where filming was not generated before printing 24000 sheets, a half tone fixed image was printed after 24000 sheets were printed. The evenness of the half tone was visually evaluated, and the evenness of the solid images was visually examined. The results are shown in Table 2.

TABLE 2

| | Particle Size Distribution | | | | | | | | | | | |
|---|---|---|---|---|---|---|---|---|---|---|---|---|
| | | | Particles Having Particle Sizes of ($1.4 \times D_{50}v$) μm or More | | Particles Having Particle Sizes of ($0.6 \times D_{50}p$) μm or Less | | | Standard Deviation in | | | | |
| | $D_{50}v$ | $D_{50}p$ | $1.4 \times D_{50}v$ | Content (% by Volume) | $0.6 \times D_{50}p$ | Content (% by Number) | $D_{50}v \times 1/4$ | Volume Base Particle Size Distribution | True Density | Formula (a) | Generation of Filming | Evenness of Solid Image |
| Ex. No. | | | | | | | | | | | | |
| 1 | 4.5 | 4.0 | 6.3 | 0.9 | 2.4 | 3.1 | 1.125 | 1.0 | 1.2 | 19 | Not Generated | Slightly uneven |
| 2 | 5.3 | 4.8 | 7.4 | 2.5 | 2.9 | 1.8 | 1.325 | 1.1 | 1.2 | 44 | Not Generated | Excellent |
| 3 | 5.5 | 5.0 | 7.7 | 2.3 | 3.0 | 1.4 | 1.375 | 1.2 | 1.2 | 134 | Not Generated | Excellent |
| 4 | 3.8 | 3.2 | 5.3 | 3.0 | 1.9 | 3.9 | 0.95 | 0.9 | 1.2 | 16 | Not Generated | Slightly uneven |
| 5 | 5.6 | 5.0 | 7.8 | 2.4 | 3.0 | 4.6 | 1.4 | 1.4 | 1.2 | 24 | Not Generated | Uneven |
| 6 | 6.7 | 6.0 | 9.4 | 4.1 | 3.6 | 1.5 | 1.675 | 1.4 | 1.2 | 29 | Not Generated | Slightly uneven |
| 7 | 5.5 | 5.1 | 7.7 | 0.8 | 3.3 | 2.1 | 1.375 | 1.0 | 1.2 | 155 | Not Generated | Excellent |
| Comp. Ex. No. | | | | | | | | | | | | |
| 1 | 6.0 | 5.3 | 8.4 | 5.2 | 3.2 | 3.5 | 1.5 | 1.5 | 1.2 | 0 | Generated after 12000 sheets | — |
| 2 | 5.5 | 5.0 | 7.7 | 2.7 | 3.0 | 1.7 | 1.375 | 1.3 | 1.2 | 188 | Generated after 20000 sheets | — |
| 3 | 5.8 | 5.0 | 8.1 | 4.5 | 3.0 | 2.5 | 1.45 | 1.6 | 1.2 | 0 | Generated after 15000 sheets | — |

It can be seen from the above results that the toner obtained by Examples has excellent durability because the toner has excellent filming resistance and the evenness of the solid image in sufficiently practical or higher than the practical level even in some cases where the solid images show some unevenness even when subjected to the continuous printing, as compared with the toners obtained by Comparative Examples.

The toner obtained by the present invention can be used, for instance, for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner comprising the steps of:

(I) melt-kneading a raw material mixture containing a resin binder and a colorant;

(II) cooling the melt-kneaded mixture obtained in the step (I) and pulverizing the cooled mixture to give a pulverized product having a volume-median particle size ($D_{50}v$) of from 10 to 1000 μm;

(III) pulverizing the pulverized product obtained in the step (II) in the presence of from one to m external additives having an average particle size of from 8 to 50 nm; and (IV) classifying the pulverized product obtained in the step (III), wherein the resulting toner has a volume-median particle size ($D_{50}v$) of from 3.5 to 8 μm, and the total amount of m of external additive(s) in the step (III) satisfies the formula (a):

$$10 \le P \le 180 \qquad \text{(a)}$$

$$\text{wherein } P = \sum_{n=1}^{m} \frac{Dt \cdot \rho t}{4 \cdot dn \cdot \rho n} \times Cn \times 100 \times \frac{1}{2}$$

wherein Dt is a volume-median particle size of a desired toner ($D_{50}v$, μm); dn is an average particle size (μm) of an external additive n; ρt is a true density of mother toner particles; ρn is a true density of an external additive n; Cn is a weight ratio of an external additive n to the pulverized product obtained in the step (II); and m is an integer of 1 or more, and wherein the resulting toner has a standard deviation of a volume base particle size distribution of ¼ of the toner $D_{50}v$ or less, and contains particles having particle sizes of (1.4× the toner $D_{50}v$)

μm or more in an amount of 5% by volume or less, and particles having particle sizes of (0.6× the toner number-median particle size ($D_{50}p$)) μm or less in an amount of 5% by number or less.

2. The process according to claim 1, wherein the external additive in the step (III) is silica.

3. The process according to claim 1, wherein the pulverized product obtained in the step (II) is mixed with the external additive before the step (III).

4. The process according to claim 1, further comprising the step of:

(V) adding the external additive to the toner obtained in the step (IV).

5. The process according to claim 1, wherein the step (III) comprises pulverizing the pulverized product obtained in the step (II) with a fluidized bed jet mill.

6. The process according to claim 5, wherein a pulverization pressure with the fluidized bed jet mill is from 0.5 to 1 MPa.

7. The process according to claim 1, wherein the step (IV) comprises classifying the pulverized product with a classifier, the classifier comprising a classifying rotor comprising a driving shaft arranged in a casing as a central shaft thereof in a vertical direction; and a stationary spiral guiding vane arranged to share the same central shaft as the classifying rotor, wherein the stationary spiral guiding vane is arranged in the classification zone on an outer circumference of the classifying rotor with a given spacing to the outer circumference of the classifying rotor.

8. The process according to claim 1, wherein the toner has a number-median particle size ($D_{50}p$) of from 3 to 7.5 μm.

9. The process according to claim 8, wherein $D_{50}p$ is from 3 to 6 μm.

10. The process according to claim 1, wherein in the step (III) the external additive has an average particle size of from 12 to 20 nm.

11. The process according to claim 1, wherein $30 \leqq P \leqq 140$.

12. The process according to claim 1, wherein the pulverized product has a $D_{50}v$ of from 10 to 100 μm.

13. The process according to claim 1, wherein the resulting toner has a $D_{50}v$ of from 4 to 6 μm.

* * * * *